United States Patent [19]

Bocking et al.

[11] Patent Number: 4,681,175

[45] Date of Patent: Jul. 21, 1987

[54] AUTO-COUPLING TOOL FOR DRILL-PIPES

[76] Inventors: Bruce Bocking, 550 E. Foothill Blvd., Glendora, Calif. 91740; Joe A. Cervantes, Jr., 265 Kirkwall Rd., Azusa, Calif. 91702; Douglas H. Green, 16740 Bygrove, Covina, Calif. 91722; Bruce W. La Sota, 1425 S. Almansor, Alhambra, Calif. 91801; David H. Marshall, 1621 Bramhall, Glendora, Calif. 91740; Bernard Rodriguez, 3828 Baldwin Park Blvd., Baldwin Park, Calif. 91706; Glen Van Gorden, 308 E. Shorb St., Alhambra, Calif. 91801

[21] Appl. No.: 658,044

[22] Filed: Oct. 5, 1984

[51] Int. Cl.[4] ..... E21B 7/20

[52] U.S. Cl. ..... 175/393; 166/98; 285/40; 294/86.22

[58] Field of Search ..... 175/388, 393, 394; 166/98, 301; 294/86.22, 86.34; 285/39, 40; 81/53.2

[56] References Cited

U.S. PATENT DOCUMENTS

| | | | |
|---|---|---|---|
| 1,524,265 | 1/1925 | Lester | 294/86.22 |
| 2,013,923 | 9/1935 | Naccarato | 81/53.2 |
| 2,201,159 | 5/1940 | Clow | 175/394 |
| 2,377,249 | 5/1945 | Lawrence | 166/98 |
| 2,734,581 | 2/1956 | Bonner | 166/298 |
| 2,865,454 | 12/1958 | Richards | 166/301 |
| 2,999,572 | 9/1961 | Hinckley | 175/388 |
| 3,120,871 | 2/1964 | De Cordova | 294/86.34 |
| 3,268,003 | 8/1966 | Essary | 166/301 |
| 4,226,164 | 10/1980 | Carter | 285/39 |
| 4,496,011 | 1/1985 | Mazo et al. | 175/388 |

*Primary Examiner*—Stephen J. Novosad
*Assistant Examiner*—William P. Neuder
*Attorney, Agent, or Firm*—Bruce L. Birchard

[57] ABSTRACT

An automatic broken-drill-pipe-intercoupling tool having, a body portion with, at one end, a female threaded adapted to cooperate with the threaded male end of the retrievable portion of a broken drill pipe and at the other end a tapered, multi-interwined-spiral bit portion, integral with the body portion, the body portion having flats thereon to permit tightening of the tool on the retrievable portion of the broken drill pipe.

1 Claim, 2 Drawing Figures

AUTO-COUPLING TOOL FOR DRILL-PIPES

BACKGROUND OF THE INVENTION

1. Field of the Invention

This invention relates to tools for drilling pipeline holes and, more particularly, to tools for simplifying the process of repairing drilling-pipes, in situ.

2. Prior Art

In the process of laying pipes and tubing for utility applications, for example, laying telephone cables and heating-gas pipes, it is necessary that horizontal pipeline holes be drilled or bored in the earth. The process normally involves using a drill-pipe or tube at the leading end of which a bit is carried. The drill-pipe and the bit which it carries are rotated, either manually or by means of a motor, such as an air motor, while the drill-pipe is urged forward. Initially a trench or slot may be dug in the earth to give the hole the desired initial depth. Sometimes "spud" boring is used to reduce the length of the initial trench. "Spud" boring is slant drilling at a predetermined slope so as to arrive at the target area with the desired depth of the hole. In either case, as the drill-pipe is rotated and advanced it is subjected to a high torsional forces and significant shear stresses. Occasionally these shear stresses are large enough to break the drill-pipe which stops the drilling process until the location of the break is determined and the pipe is welded back into one piece.

The prior art procedure for fixing broken drill-pipe was both time consuming and difficult. In that procedure there were three steps in retrieving and re-attaching the broken pipe to the main drill-pipe: the installation crew has to (1) determine the location of the break, (2) excavate a large enough hole around the break to enable a welder to get in and work and then, (3) have the welder weld the pipe. The problem is not over at that time, because it is nearly impossible to perfectly align the two portions of a broken pipe, so a weak point is generated at the weld. As the job continues, it is somewhat common for the weld to break. Thus, the digging and welding process has to be repeated.

An investigation by these inventors over the last two years of dealing with this type of drill-pipe showed that it took approximately 17 extra hours to complete a job where a drill-pipe break occurred.

Therefore, it is a first object of this invention to overcome the problems of the prior art.

It is a further object of this invention to provide a device for quickly and easily overcoming the problem of re-joining, for actual and effective continued drilling, the several segments of a broken drill-pipe.

SUMMARY OF THE INVENTION

An automatic-coupling tool (hereinafter referred to as "the bocking tool") is provided having, at one end, of a body portion, a female thread adapted to cooperate with the threaded male end of the retrievable portion of the broken drill-pipe. At the other end of the bocking tool is a tapered, multi-intertwined-spiral bit portion, integral with the body portion, having flats thereon to permit tightening the bocking tool on the end of the retrievable drill-pipe. It should be understood that the stub of the broken drill-pipe portion that has been retrieved, and any union that held that stub, are removed from the retrieved drill-pipe so that the female-threaded body portion of the bocking tool may be put in place on the male-threaded end exposed by removing such union and broken-pipe stub. The retrieved drill-pipe with the bocking tool in place is re-introduced into the drill-hole until the bit end of the bocking tool enters the broken drill-pipe portion remaining in the ground.

As the drill-pipe is turned the bocking tool bit portion engages the inner wall of the broken drill-pipe and causes that broken drill-pipe, and everything connected to it, to rotate, and advance as it did before the break. The drill-pipe has, effectively, been made whole without welding.

As long as the turning process continues this bocking tool connection will stay attached. If the tool does not self-attach itself, only a small hole has to be excavated at the location of the break in pipe. This small hole enables a field service man to reach in and help guide the spiral end of the bocking-tool into the broken pipe. After insertion is made, the drilling job can continue as if the break had never occurred.

The bocking tool has been field tested with considerable success. The time saved by using the bocking tool to repair a pipe break is approximately 13.5 man hours. In the tests it took only 3.5 man hours to repair the pipe with the aid of the bocking tool (an extra 3 man hours should be added if minor excavation is needed), compared to 17 man hours when not using the tool.

BRIEF DESCRIPTION OF THE DRAWINGS

The invention, both as to its structure and operation, can best be understood by reading the specification which follows in conjunction with the drawings herein, in which.

DETAILED DESCRIPTION OF THE PREFERRED EMBODIMENT

Figure 1:
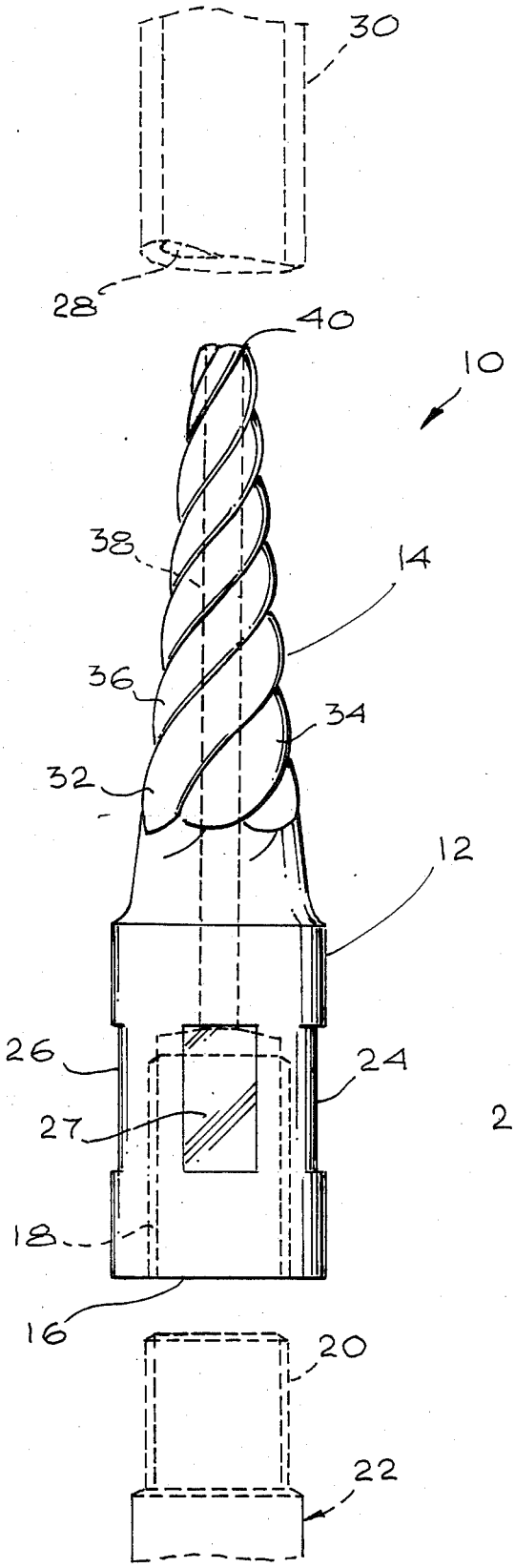
FIG. 1 is a side, elevational view of the bocking tool, according to the present invention, showing, in phantom, the elements with which it cooperates; and, FIG. 2 is an end view of the tool of FIG. 1.
Figure 2:
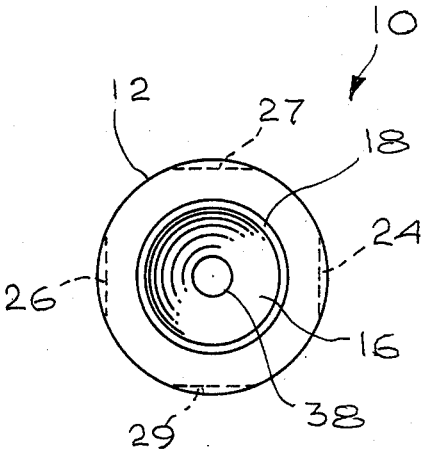

In FIG. 1 bocking tool 10 includes a body portion 12 and a bit portion 14. Body 12 has a coaxial opening 16 therein which has threads 18 to receive and cooperate with the male threads 20 on drill or bore-pipe or tube 22. Body portion 12 carries pairs of opposed flats 24,26,27,29 for example, to permit application of a wrench (not shown) to body 12 for tightening tool 10 on drill-pipe 22.

Bit portion 14 is tapered and carries intertwined spiral ridges 32,34,36, the effect of which is to engage and grip the inner wall 28 of broken drill-pipe 30, in coaxial relationship with such wall, and thus to firmly join drill-pipe section 22 with broken drill-pipe 30. The combination then acts as an integral drill-pipe so long as rotation of tool 10 continues and continues in the correct direction; in this case clockwise.

Coaxial opening 38 extends from internal opening 16 in body 12 thru the entire length of bit portion 14. The purpose of opening 38 is to permit the introduction of water into the most forward point of contact 40 of bit portion 14 with the soil being drilled so as to remove, hydraulically, soil or other material which has been loosened in the drilling process.

To reiterate, briefly, when drilling a hole to receive a utility pipe or conduit the drill-pipe sometimes breaks beneath the ground because of torsional stresses. In the past, after the site of the break was known, a large hole had to be dug to permit a welder to re-join the severed drill-pipe. This procedure was time consuming and expensive and left a weakened pipe, which frequently re-broke.

With the tool according to this invention, the retrievable section of the broken pipe is simply pulled out of the ground, any stub associated union is removed, and the bocking tool is applied to the exposed, threaded end of the drill-pipe. The drill-pipe carrying the tool according to this invention, is re-inserted in the hole which has previously been drilled and is pushed forward until it engages the inner wall of the section of the broken pipe remaining in the ground. Rotation of the drill-pipe and, hence, rotation of tool 10 causes its tapered bit section 14 to enter the pipe 30 and its spiral members 32, 34, 36 to firmly dig into wall 28, so that the drilling procedure may continue.

The bocking tool 10 may be made of S-7 tool steel heat treated to a hardmess of 59 Rockwell.

It should be understood that the drill-pipe breakage described herein may occur in either the drilling or reaming steps mormally attendant to laying underground pipes. The bocking tool works equally well in either phase of the laying process.

While a particular embodiment of the present invention has been shown and described, it will be apparent to those skilled in the art that modifications and variations may be made without departing from the true spirit and scope of this invention. It is the purpose of the appended claims to cover all such variations and modifications.

What is claimed is:

1. A tool for use in installing utility pipes in the ground, including:

a unitary body;

said unitary body having a coupling portion and a bit portion;

said coupling portion having a hollow region therein, said hollow region bearing threads on the inner wall thereof, said threads being sized and shaped to receive the male threads on a first utility-pipe section;

said bit portion being rigid and being coaxial with said coupling portion, and said bit portion being tapered, and having its narrow end remote from said coupling portion and bearing, on the outer surface thereof, in coaxial relationship with said bit portion, a plurality of intertwined, spirally-disposed, sharp ridges for engaging the inner wall of a second utility-pipe section to cause such second utility-pipe section to rotate in unison with said first utility-pipe section;

said bore-pipe coupling tool including, in addition, an axial passageway extending from said hollow region of said coupling portion through the entire length of said bit portion, whereby debris accumulating around narrow end of said tool may be flushed out by the introduction of water under pressure into said axial passageway in said bit portion, thus facilitating the movement of the tool through the ground;

said coupling portion bearing opposed flat outer surfaces thereon.

* * * * *